United States Patent [19]

Norton et al.

[11] Patent Number: 4,574,498

[45] Date of Patent: Mar. 11, 1986

[54] SOLE FOR ATHLETIC SHOE

[75] Inventors: Edward J. Norton, Kingston, N.H.; Ronald L. Clay, W. Boxford; Zenon O. Smotrycz, Woburn, both of Mass.

[73] Assignee: New Balance Athletic Shoe, Inc., Boston, Mass.

[21] Appl. No.: 462,967

[22] Filed: Feb. 1, 1983

[51] Int. Cl.[4] ..... A43B 5/00

[52] U.S. Cl. ..... 36/114; 36/67 A; 36/126

[58] Field of Search ..... 36/114, 126, 127, 128, 36/129, 130, 67 A, 67 R, 67 D, 67 B

[56] References Cited

U.S. PATENT DOCUMENTS

| | | | |
|---|---|---|---|
| 173,241 | 12/1921 | Smith | 36/67 A |
| 3,341,952 | 9/1967 | Dassler | 36/128 |
| 3,668,792 | 6/1972 | York | 36/114 |
| 4,212,120 | 7/1980 | Bowerman | 36/129 |
| 4,262,435 | 4/1981 | Block et al. | 36/129 |
| 4,288,929 | 9/1981 | Norton et al. | 36/69 |
| 4,361,971 | 12/1982 | Bowerman | 36/129 |
| 4,378,641 | 3/1983 | Tarlow | 36/114 |
| 4,380,878 | 4/1983 | Skaja | 36/129 |
| 4,392,312 | 7/1983 | Crowley | 36/67 A |
| 4,399,621 | 8/1983 | Dassler | 36/129 |

FOREIGN PATENT DOCUMENTS

| | | | |
|---|---|---|---|
| 2022974 | 11/1971 | Fed. Rep. of Germany | 36/128 |
| 2927635 | 1/1981 | Fed. Rep. of Germany | 36/128 |
| 1554061 | 12/1968 | France | 36/114 |

*Primary Examiner*—Werner H. Schroeder
*Assistant Examiner*—Mary A. Ellis
*Attorney, Agent, or Firm*—Pennie & Edmonds

[57] ABSTRACT

Footwear including an upper and a sole with a plurality of cleats extending from the sole arranged in groupings of cleats adapting the footwear to field sports. A control device extends upwardly of the sole around the heel, a pair of spines extend along the sole between cleats of a grouping of cleats within the region of the ball and heel of the foot, and a flex area is provided in the sole in the general off-center alignment of the heads of the metatarsal bones.

6 Claims, 6 Drawing Figures

SOLE FOR ATHLETIC SHOE

DESCRIPTION

1. Technical Field

The invention relates to an athletic shoe and particularly to a construction of sole for an athletic shoe capable of supporting the foot and controlling pronation in the running cycle. The athletic shoe may have a preferred use with field sports, such as soccer.

2. Background Art

Athletic shoes according to recent design and construction development generally are fabricated from soft, pliable, light-weight materials to permit exercise without unnecessarily adding to the stress of the exercise through use of heavier, more rigid shoes. While there have been improvements in the design and construction of athletic shoes many users have developed injury which oftentimes may be traced directly to foot problems and possibly shortcomings in the basic design and construction of the athletic shoes that are worn.

Whatever the type of activity, such as running, jogging and the like, either on the surface of a road, track or field, the individual normally will require support at the joints.

The recognized cycle of foot movement during running, jogging and the like typically is found to be heel strike, ball strike, pronation, release and supination. It has been found that a recent design and construction of athletic shoe, for example, see U.S. Pat. No. 4,288,929 to Norton et al, has addressed the problem of providing support and stabilization security in the rear foot in the neutral plane; but these designs and constructions have not satisfactorily addressed those problems that may arise because of a lack of provision of flex and torsional rigidity along the longitudinal arch and under the full instep, and the need for flex of the shoe with substantially less resistance to flex along the off-center alignment of the metatarsal head bone group in the forefoot.

The sole for athletic shoe of the invention which is particularly suited for use with field sports not only functions to control pronation and thereby eliminate or at least reduce incidents of running related injury, it also functions to eliminate or at least reduce the potential for injury as may result from collapse of the instep or stretching of a key ligament in the bottom of the foot.

SUMMARY OF THE INVENTION

The invention is directed to an athletic shoe of the type used for field sports and to a sole which is attached to a lasted upper. The sole of the athletic shoe includes a control device which preferably is an integral part of the sole for support of the foot in the neutral plane and control of roll of the foot during a running cycle. The sole also includes a pair of spines that extend along the medial and lateral sides of the athletic shoe from the region of the ball of the foot to the heel for the purpose of providing flex and torsional rigidity to the longitudinal arch and under the full instep. The spines are of maximum height at the heel of the foot and taper to a minimum height or zero elevation in the region of the ball of the foot in the forefoot.

Finally, the sole of the athletic shoe includes a flex bar which is anatomically designed to follow the off-center alignment of the metatarsal head bone group in the forefoot. The flex bar is preferably virtually centered between a group of cleats extending from the sole in the forward and ball areas of the foot. The flex bar is characterized by an area of sole that is of somewhat less thickness than the overall thickness of the sole.

BEST MODE FOR CARRYING OUT THE INVENTION

Figure 1:
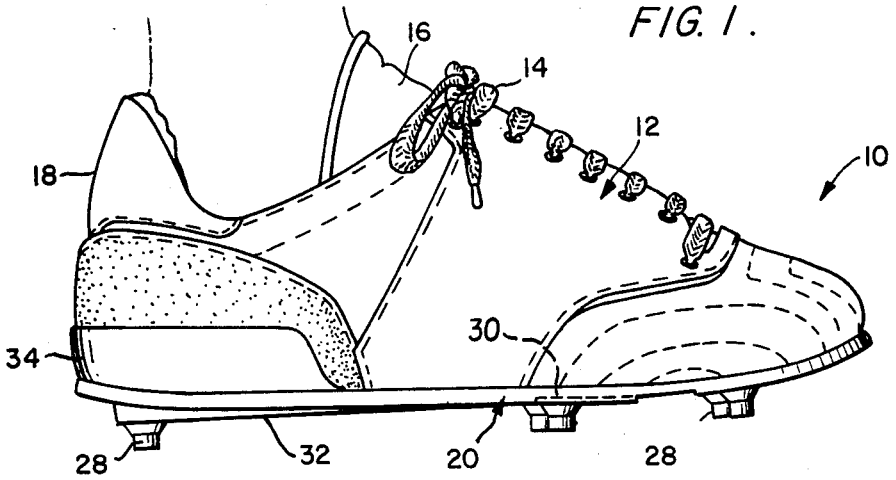
FIG. 1 is a side elevation of the athletic shoe of the invention.

The athletic shoe 10 (hereafter "shoe") as may be seen in FIG. 1 is of the type having a particular adaptation to field sports, such as soccer. The shoe includes a lasted upper 12 formed of leather, a synthetic fabric material, such as nylon or formed of other fabrics which are conventionally used in the construction of shoes of the type described herein.

The upper generally may be considered as providing a foot receiving opening and a lacing system 14 for securing the upper around the arch of the foot of the wearer. A tongue 16 carried by the upper is disposed between the foot and the lace; and a backtab 18 extends upwardly from the heel generally within the region of the Achilles tendon.

Figure 2:
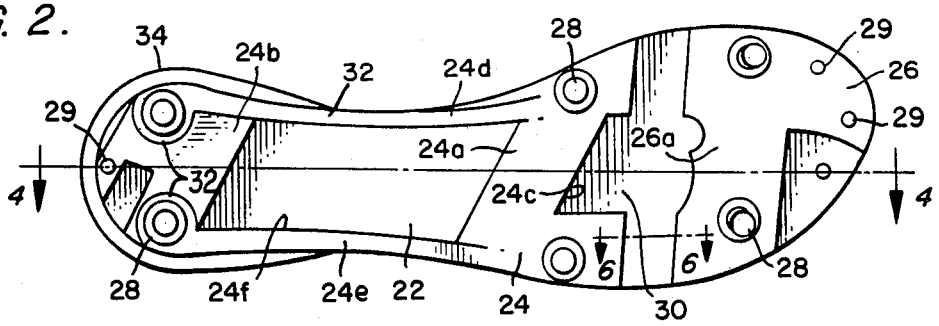
FIG. 2 is a bottom view of the construction of sole of the athletic shoe.
Figure 3:
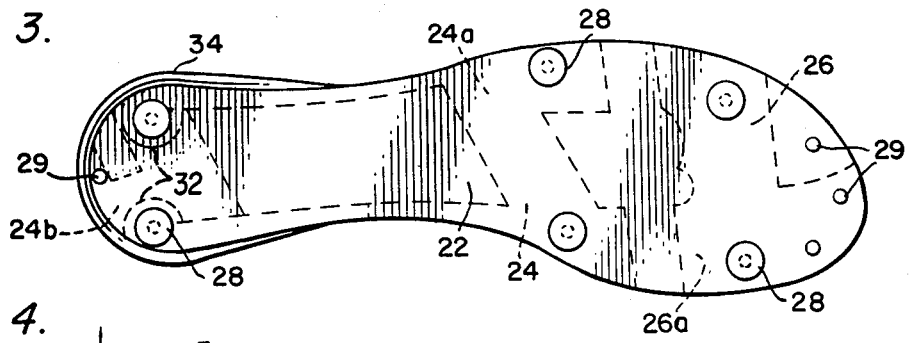
FIG. 3 is a plan view of the sole of the athletic shoe.
Figure 4:
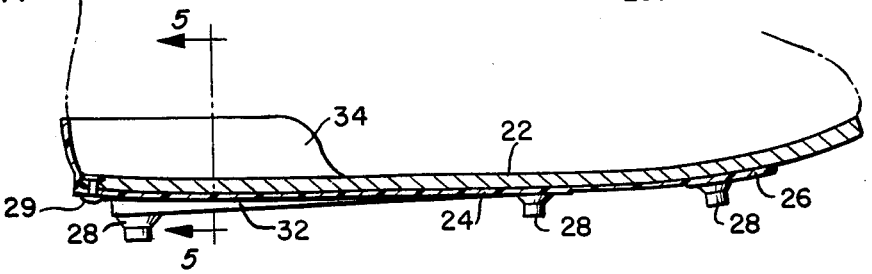
FIG. 4 is a view in section as seen along the line 4—4 in FIG. 2.
Figure 5:
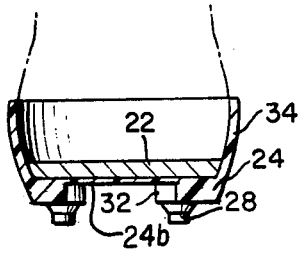
FIG. 5 is a view in section as seen along the line 5—5 in FIG. 4.

A sole 20, according to the general discussion, above, completes the shoe. The sole, seen perhaps to best advantage in FIGS. 2 and 4, preferably will be formed of a material having properties including durability and flexibility among possible others to render it useful in combination with the upper in a construction of shoe for purposes discussed herein. In a preferred embodiment, the sole may be formed of nylon 12 material.

The sole 20 is of one-piece construction including a base portion 22 and an outer portion. The outer portion includes a section 24 within the region of the forefoot, at the ball of the foot, extending below the arch along the lateral and medial sides of the sole to the location of the heel of the foot. A further section 26 is located within the forward section of the foot. The opposing ends of the sections of the outer portion are spaced longitudinally of the shoe and each section provides at least one area extending generally across the shoe between the medial and lateral sides. Particularly, the forward section provides an area 26*a*, and the section extending below the forefoot, along the arch, to the location of the heel 3 along the arch, provides areas 24*a*, 24*b*. These areas each serve as a mounting surface for a pair of cleats 28. Thus cleats are located within the forward section, the forefoot at the ball of the foot and the location of the heel of the foot in a disposition adjacent the region of the medial and lateral sides of the shoe. The cleats may be attached to sole 20 in any conventional manner, and both the sole and upper may be attached in any conventional manner as well. For example, a plurality of rivets 29 may serve as the instrumentality for attachment of the sole and upper.

The region between the forward extreme of area 24*a* of section 24, facing section 26 is cut away at 24*c* to define a bar 30. The purpose of the bar is to allow the shoe to flex more evenly than would otherwise be expected. The flex bar is substantially centered between the groupings of cleats 28 within the sections 24 and 26. The flex bar, further, is disposed in an off-center alignment thereby to follow the heads of the metatarsal bones in the front of the ankle and arch of the foot.

The sole 20 may be of substantially any thickness, and the base portion 22 may comprise the major portion of the overall thickness. For example, the base portion may comprise about two-thirds of the overall thickness. The flex bar, likewise, may comprise about two-thirds of the overall thickness. Without any intent to limit the invention, but rather to set out what may be considered a preferred embodiment, the sole may have an overall thickness of about 4 mm and the base portion may be about 2.5 mm in thickness. Further, the flex bar will be about 23 mm in length (or width across the shoe as heretofore set out).

It is the function of the flex bar to permit flexing of the shoe under circumstances of less resistance to flexure, and it is considered that the flex bar will enhance function of the shoe from an initial break-in standpoint to a performance and feel-of-the-surface standpoint. Further still, the flex bar and the ability of an even flex of the shoe under circumstances of less resistance will impart a capability of reduction of stretching of ligaments in the bottom of the foot, a condition that is commonly referred to as plantar facitis.

Figure 6:
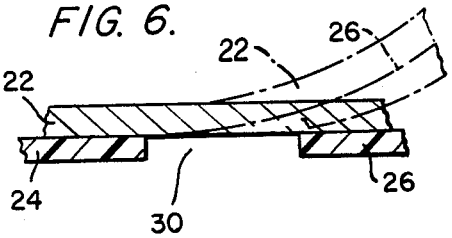
FIG. 6 is a partial sectional view of a portion of the sole in a normal disposition and a disposition of flexure.

Reference may be had to FIG. 6 which represents an enlarged, partial view of the sole 20, and the manner of flexure of both the base portion 22 and the section 26 of the outer portion about flex bar 30.

A pair of spines 32 extend along the outer portion of the sole within the section 24. Particularly, the spines extend along and form a part of a pair of substantially longitudinal extensions 24*d*, 24*e* which follow the lateral and medial sides of the sole, connecting the area 24*a* within the region of the forefoot at the ball of the foot with the area 24*b* at the heel of the foot. The extensions and spines, together with the areas 24*a*, 24*b* outline what may be considered a central cutout area 24*f*. In actuality, the central cutout area exposes a portion of the sole defined by the base portion 22. Each spine, as may be seen in FIGS. 1, 2, 4 and 5, extends from a stud 28 within the area 24*b* toward a stud 28 within the area 24*a*. Each spine, further, may be of a width (the dimension across the sole) substantially equal to the width of an extension 24*d*, 24*e* and supported on one of the extensions to provide a mount for a rear stud (that is, one of the studs within the region of the heel). The spines taper from a maximum height about equal to the thickness of the sole at the heel to a feather edge within the region of a stud in the area 24*a*.

The spines more particularly, and again the dimensions are presented for purposes of illustration and not in a limiting sense, may decrease in height gradually from a maximum of 4.5 mm at the location of a respective cleat in the area 24*b* to a minimum of zero height at a respective cleat in the area 24*a* of section 24. The purpose of the spines is to introduce both flex and torsional rigidity along the longitudinal arch and under the full instep of the shoe. The shoe, thus, benefits from substantial reduction of a potential for collapse of the instep of the shoe and thereby substantially reduces the likelihood of injury to the foot caused by collapse of the instep. Preferably, the spines may be molded integrally with the sole.

A control device 34 extends upwardly from the sole 20 within the region of the heel of shoe 10. The control device which comprises an integral part of the sole extends around the heel from the regions of the ankles on the medial and lateral sides of the foot. Again, without any intent to limit the invention, but rather to describe a combined control device and sole which has been used successfully, the control device may extend upwardly to a height of about 25 mm, measured from a flat undersurface. The control device is of substantially constant height around the heel, along the lateral and medial sides of the sole and tapers from a maximum height toward the sole in the region of the arch.

It is the function of the control device to support the foot in a neutral plane, and to control pronation and supination during a running action characterized as including the following events, namely heel strike, ball strike, pronation, release and supination. As used herein, the term "pronation" defines a foot roll to the medial or inside of the foot, and "supination" may be considered the rotation of a joint (hip, knee, ankle and so forth) backward and away from the midline of the body. The control device situated as described provides a mechanical control in stabilization wherein the foot of the wearer is secured substantially in a neutral plane, that is, the natural position of the foot while in a normal gait cycle thereby to reduce the amount of roll of the foot. Reduction in the amount of roll of the foot results in reduction in shoe destruction and/or the potential at least for rear foot injury. The control device, further, may be of a thickness of wall in the range of about 1.4 to 1.6 mm.

The nylon 12 material of the sole will provide that degree of strength, sturdiness, durability, support, and so forth as necessary for the sole with integral control device of the athletic shoe, as described herein. This material further, is capable of being molded according to well known molding techniques.

We claim:

1. Footwear including an upper, a sole, and a plurality of cleats mounted on the sole and extending downwardly from the sole adapting the footwear to field sports, and wherein the improvement comprises a sole including a base layer and an outer layer, said outer layer providing a surface for mounting each cleat and comprised of two separate sections, one extending from the heel portion along a lateral and medial side of the arch and the other extending from the toe portion of the sole to an area of said sole of reduced thickness, said area of reduced thickness being disposed between opposing regions of said sections and extending to the lateral and medial sides to follow generally an off-center alignment of the heads of the metatarsal bones in the front of the ankle and arch of the foot, thereby imparting to said sole along said off-center alignment a capability of flex with less resistance, a pair of spines, each spine extending between a cleat in said heel portion and a cleat in the forefoot at the ball portion, along one of the medial and lateral sides of the sole to introduce a flex and torsional rigidity to the longitudinal arch and full instep of the foot, and a control device within a region extending from the heel portion upwardly of the sole and forwardly toward the toe portion along the lateral and medial sides of the sole, said control device formed as a wall having a height throughout its length sufficient to confine the heel, provide support and rigidity of the foot in a neutral plane throughout a normal range of motion of the foot and provide a surface at least for partial securement of said upper to said sole.

2. The footwear of claim 1 wherein said control device is an integral part of said sole.

3. The footwear of claim 1 wherein said control device extends forwardly toward said toe to about the region of said arch.

4. The footwear of claim 3 wherein said control device tapers from a maximum height in the region of said arch toward said sole.

5. A sole for footwear of the type used in field sports, and wherein the improvement in said sole comprises a base layer and an outer layer, said outer layer providing a surface adapted for mounting a plurality of cleats, and comprised of two separate sections, one extending from the heel portion along a lateral and medial side of the arch and the other extending from the toe portion of the sole to an area of said sole of reduced thickness, said area of reduced thickness being disposed between opposing regions of said sections and extending to the lateral and medial sides to follow generally an off-center alignment of the heads of the metatarsal bones in the front of the ankle and arch of the foot, thereby imparting to said sole along said off-center alignment a capability of flex with less resistance, a pair of spines, each spine extending between a cleat in said heel portion and a cleat in the forefoot at the ball portion, along one of the medial and lateral sides of the sole to introduce a flex and torsional rigidity to the longitudinal arch and full instep of the foot, and a control device within a region extending from the heel portion upwardly of the sole and forwardly toward the toe portion along the lateral and medial sides of the sole, said control device formed as a wall having a height throughout its length sufficient to confine the heel, provide support and rigidity of the foot in a neutral plane throughout a normal range of motion of the foot and provide a surface at least for partial securement of said upper to said sole.

6. Footwear including an upper, a sole, and a pluraity of cleats mounted on the sole and extending downwardly from the sole adapting the footwear to field sports, and wherein the improvement comprises a sole including a base layer and an outer layer, said outer layer providing a surface for mounting each cleat and comprised of two separate sections, one extending from the heel portion along a lateral and medial side of the arch and the other extending from the toe portion of the sole toward an area of said sole of reduced thickness, said area being disposed between opposing regions of said sections and extending to the lateral and medial sides to follow generally an off-center alignment of the heads of the metatarsal bones in the front of the ankle and arch of the foot, thereby imparting to said sole along said off-center alignment a capability of flex with less resistance, a pair of spines, each spine providing a mounting for a cleat in the heel portion and extending between said cleat in said heel portion and a cleat in the forefoot at the ball portion, along one of the medial and lateral sides of the sole to introduce a flex and torsional rigidity to the longitudinal arch and full instep of the foot, and each said spine decreasing in height along said extension from a maximum height at a respective cleat in said heel portion to substantially zero height at said grouping of cleats at said ball portion of said sole, and a control device within a region extending from the heel portion upwardly of the sole and forwardly toward the toe portion along the lateral and medial sides of the sole, said control device formed as a wall having a height throughout its length sufficient to confine the heel, provide support and rigidity of the foot in a neutral plane throughout a normal range of motion of the foot and provide a surface at least for partial securement of said upper to said sole.

* * * * *